United States Patent [19]

Evans

[11] 4,287,957

[45] Sep. 8, 1981

[54] COOLING A DRILLING TOOL COMPONENT WITH A SEPARATE FLOW STREAM OF REDUCED-TEMPERATURE GASEOUS DRILLING FLUID

[76] Inventor: Robert F. Evans, 631 Honeywood La., La Habra, Calif. 90631

[21] Appl. No.: 176,338

[22] Filed: Aug. 8, 1980

Related U.S. Application Data

[63] Continuation-in-part of Ser. No. 153,540, May 27, 1980, which is a continuation-in-part of Ser. No. 95,532, Nov. 19, 1979, Pat. No. 4,240,674.

[51] Int. Cl.[3] ..... F21B 9/08; F16C 19/34

[52] U.S. Cl. ..... 175/17; 175/71; 175/227; 175/339; 175/371; 308/8.2

[58] Field of Search ..... 175/17, 66, 212, 227, 175/371, 372, 339; 308/DIG. 14, 8.2

[56] References Cited

U.S. PATENT DOCUMENTS

| | | | |
|---|---|---|---|
| 1,870,696 | 8/1932 | Taylor | 175/17 |
| 2,861,780 | 11/1958 | Butler | 175/212 |
| 3,303,900 | 2/1967 | Kloesel, Jr. et al. | 175/339 |
| 3,612,192 | 10/1971 | Magalari, Jr. | 175/17 |
| 3,650,337 | 3/1972 | Andrews et al. | 175/17 |
| 3,825,080 | 7/1974 | Short | 175/329 |
| 3,935,911 | 2/1976 | McQueen | 175/228 |
| 3,964,554 | 6/1976 | Ricks et al. | 175/17 |
| 4,073,354 | 2/1978 | Rowley et al. | 175/329 |

*Primary Examiner*—James A. Leppink
*Attorney, Agent, or Firm*—John R. Ley

[57] ABSTRACT

A flow stream of drilling gas in a gaseous drilling fluid circulation drilling system is separated from that drilling gas supplied to the drill string, and the flow stream is reduced in temperature prior to supplying the flow stream to a drilling tool component to be cooled. A heat exchanger is employed to remove heat from the flow stream, and a second separate flow stream of drilling gas is directed over the heat exchanger to remove the heat. The temperature of the second cooling stream is reduced by thermodynamic effects. Various drilling tool components may be cooled, including bearing means operative between two relatively movable parts, a seal assembly operative to seal lubricant between two relatively moving parts, and cutter elements of a drag-type drill bit. The seal assembly includes a flange-like projection member and a fluid conducting conduit in thermal transferring relationship with the projection member. Flexible flank members form a movable sealing relationship with the projection member and the reduced-temperature flow stream is forced through the conduit. The drag-type drill bit includes a plurality of cooling jet means which direct jets of reduced-temperature drilling gas from the flow stream into thermal transferring relationship with each of the cutter elements.

23 Claims, 10 Drawing Figures

COOLING A DRILLING TOOL COMPONENT WITH A SEPARATE FLOW STREAM OF REDUCED-TEMPERATURE GASEOUS DRILLING FLUID

BACKGROUND

This invention is a continuation-in-part of an invention set forth in the copending U.S. patent application Ser. No. 153,540, filed May 27, 1980 for a Caliper Seal Assembly, by the inventor herein. The application and invention for the Caliper Seal Assembly was, in turn, a continuation-in-part of an invention set forth in the copending U.S. patent application Ser. No. 95,532, filed Nov. 19, 1979 now U.S. Pat. No. 4,240,674 for a Positive Lubricating and Indexing Bearing Assembly, also by the inventor herein.

This invention pertains to method and apparatus for cooling one or more drilling tool components employed in a gaseous drilling fluid circulation drilling system. More particularly, this invention pertains to a new and improved method for cooling a separate flow stream of gaseous drilling fluid by thermodynamic effects available from a different portion of the supplied gaseous drilling fluid, and cooling the drilling tool component of the drilling system with the reduced temperature flow stream.

This invention is primarily applicable to gaseous drilling systems wherein a supply of compressed or pressurized drilling gas is directed through a drill string into the borehole and is expelled from a drill bit attached to the drill string for the primary purpose of carrying and transporting particle cuttings removed by the drill bit out of the borehole. As a subordinate but nevertheless important function, the drilling gas fluid also removes heat from the drill bit and some of the other drilling tools located in the borehole. The cooling effects available from the drilling gas are substantially reduced from those available from a liquid drilling fluid, for example, because the gas drilling fluid is less effective in removing the heat. Consequently, the drilling tool components in gas drilling systems operate at substantially elevated temperatures as compared to the components of liquid drilling fluid drilling systems.

The elevated temperatures at which the drilling tool components are required to operate in gas drilling systems have created certain limitations and restrictions in the development of gas drilling systems. For example, it is typical practice not to utilize sealed and lubricated bearings in gas drill bits, because the seals for the bearings have generally been unable to withstand the elevated temperatures for a reasonable lifetime of use prior to failing. Instead, the typical bearing in a gas drill bit is not sealed, but a supply of drilling gas is directed through the bearings and into the ambient environment of the drill bit within the borehole. The supplied gas tends to remove limited amounts of heat from the bearings, lubricate them, and prevent the entry of particle cuttings because the gas flow and gas pressure through the bearings continually forces the particle cuttings away from the bearings.

It is widespread practice to use compressed air as the drilling gas in gas drilling systems. The supply of air drilling fluid is obtained from the atmosphere at the surface of the earth from compressors or the like which compress the air and force the compressed air through a single rotational connection or swivel joint into a drilling fluid passageway in the drill string. Because a substantial amount of the work in compressing the air is transferred into heat when the air is compressed, the temperature of the compressed air drilling fluid is substantially elevated, typically to approximately two to three hundred degrees Fahrenheit. Although some cooling may occur as the air is conducted through the drilling fluid passageway in the drill string, the compressed air still remains at a substantially elevated temperature when it reaches the drill bit at the end of the drill string. The elevated temperature of the compressed air reduces its effectiveness in cooling drilling tool components, but does not substantially affect its ability to remove particle cuttings from the borehole.

Although there have been attempts to enhance the cooling effects available from drilling gas, many of these prior attempts have not obtained widespread acceptance for reasons including lack of substantial effectiveness, necessity for expensive and nonconventional drilling tools and methods, and high costs. There continues to exist a need for improved methods and apparatus for use in gas drilling systems to obtain an increased and enhanced cooling effect on drilling tool components to more effectively prolong their usable lifetime, to reduce the overall costs of drilling the borehole, and to decrease the time required to cut and form the borehole.

SUMMARY

One of the principal objectives of the present invention is to more effectively cool a drilling tool component by a separate flow stream of pressurized gaseous drilling fluid whose temperature has been reduced below the temperature of the remaining part of the supplied gaseous drilling fluid. One aspect of the present invention in this regard pertains to separating the flow stream from the remaining drilling gas supplied in the borehole, passing the flow stream through a heat exchanger which is thermally separate or isolated from the drilling component to be cooled, and cooling the flow stream passing through the heat exchanger by thermally immersing the heat exchanger in cooling drilling gas separate from that of the flow stream. The cooling drilling gas in which the heat exchanger is immersed may be obtained from a second separate stream of drilling gas whose temperature has been reduced as a result of thermodynamic pressure and volume effects within the borehole. The second stream of drilling gas may be obtained directly from the drilling fluid passageway in the drill string or from the drilling gas flowing in the annulus between the sidewall of the borehole and the exterior surface of the drill string. In either case, the thermodynamic effects of the second stream remove heat from the heat exchanger, and the flow stream in the heat exchanger is substantially cooled. The reduced temperature flow stream leaving the heat exchanger is conducted to the thermally isolated tool component, and the flow stream more effectively cools the drilling tool component because it is received by the component in a reduced-temperature state.

One of the significant improvements available from the present invention is that the single source of pressurized drilling gas supplied to the drilling fluid passageway is utilized to obtain enhanced cooling effects as well as to conventionally carry particle cuttings out of the borehole. Consequently the substantial majority of the conventional gas drilling equipment can be retained in practicing the present invention, and only limited components of the gas drilling system need be replaced with new and improved apparatus in accordance with the present invention, in order to practice the present invention.

Another significant objective of the present invention is to provide new and improved apparatus for use in a gas drilling system to obtain a separate flow stream of reduced-temperature drilling fluid for cooling a component of the drilling system, in which heat is removed from the flow stream to reduce its temperature by thermodynamic effects available from the drilling gas other than that of the flow stream. In accordance with this objective, various cooling means are provided for reducing the temperature of the gas in the flow stream which is conducted to the drilling tool component to be cooled. A heat exchanger is thermally connected in a conduit extending between the drilling fluid passageway of the drill string and the drilling tool component to be cooled. The heat exchanger is substantially thermally isolated from the drilling tool component, and heat is transferred from the flow stream by the heat exchanger. In one aspect of the invention, the heat exchanger is appropriately positioned to transfer heat into the ambient environment of drilling gas in the annulus of the borehole. The drilling gas in the annulus has been cooled as it was expelled from the wash nozzles of the drill bit. Heat is removed from the heat exchanger and the flow stream is cooled before it is directed to the component to be cooled. Another aspect of the invention involves nozzle means for expanding pressurized drilling gas obtained directly from the drilling fluid passageway. The expanded gas from the nozzle means is reduced in temperature and removes heat from the heat exchanger. A further aspect of the invention involves a vortex tube which separates a single flow of gas into a hot and a cold flow component. The vortex tube has an inlet to its vortex chamber for receiving gas from the drilling fluid passageway. Cold air from a cold air outlet of the vortex tube is directed over the heat exchanger. Hot air from a hot air outlet of the vortex tube is directed to the annulus at a position substantially removed from the heat exchanger. The various embodiments exemplifying the cooling means of the present invention obtain enhanced cooling effects compared to certain limited prior cooling arrangements recognized in the prior art.

Another important objective of the present invention is to utilize the cooling effects from the flow stream to obtain enhanced and improved performance from drag bits employing diamond material cutting elements, and to further improve the desirable heat conducting aspects of a seal assembly set forth in the aforementioned application entitled Caliper Seal Assembly. In accordance with an aspect of the present invention pertaining to drag-type bits, the reduced-temperature flow stream of gas is conducted through a plurality of cooling jet means of the bit which expel cooled gas into a thermal transferring relationship with each of the diamond material cutting elements of the bit. The strength of the attachment bond to the diamond material cutting element is maintained by reducing the temperature of the cutting elements. Maintaining the strength of the bond improves the longevity of useful lifetime of the drill bit since the cutting elements are less likely to detach from the bit. In prior art drag bits the frictional contact of the cutting elements with the earth formation generates substantial heat which reduces the strength of the bond, thereby creating significant limitations on the use of the bit.

In accordance with the aspect of the invention pertaining to further improving the enhanced temperature effects of the inventor's previous seal assembly, the reduced-temperature flow stream of gas is supplied to a fluid conductive conduit positioned in thermal transferring relation with a projection member of the seal assembly. The projection member includes a sealing surface formed thereon. A contact pad sealing surface of a flank member of the seal assembly contacts the contact surface of the projection member, and a movable sealing relationship is effected. Heat generated by the frictional movement of the sealing surfaces with respect to one another is more effectively removed by the reduced-temperature flow stream flowing through the conduit which is thermally related to the projection member. The conduit may extend within the projection member is one embodiment, or the projection member may include a heat pipe means to transfer the heat to an adjacent conduit in another embodiment. Combining this type of seal assembly, which has previously been described in the prior application as exhibiting substantially enhanced temperature withstanding capabilities, with the improved cooling effects available in accordance with aspects of the present invention, achieves further significant improvements in the field of gaseous drilling.

Other new and improved aspects and objectives of the present invention are apparent from and described in the following detailed description of preferred embodiments which refer to and encompasses the drawings briefly described below.

DRAWINGS

Figure 2:
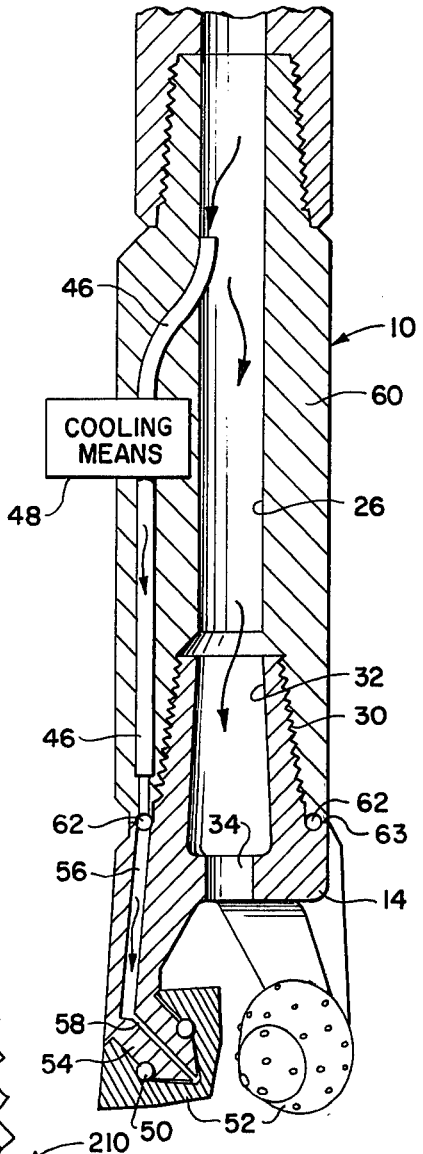
FIG. 2 is a vertical section view taken substantially in the plane of line 2—2 of FIG. 1 illustrating details of the drill string and one exemplary drill bit of the drilling system, and illustrating in block diagram form a cooling means and a conduit in accordance with the present invention.
Figure 5:
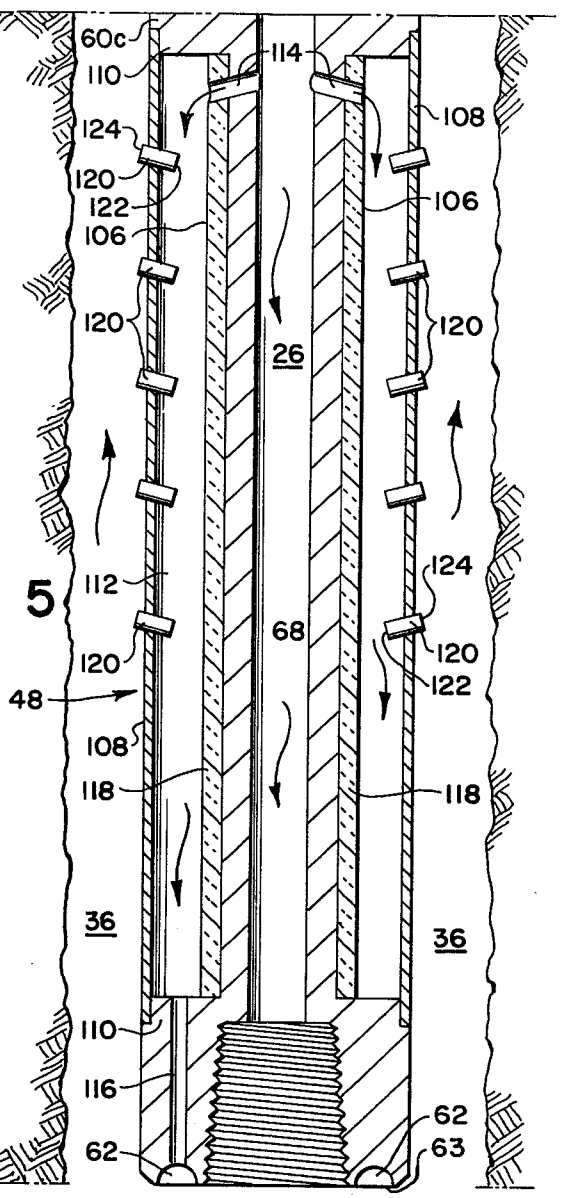
Figure 4:
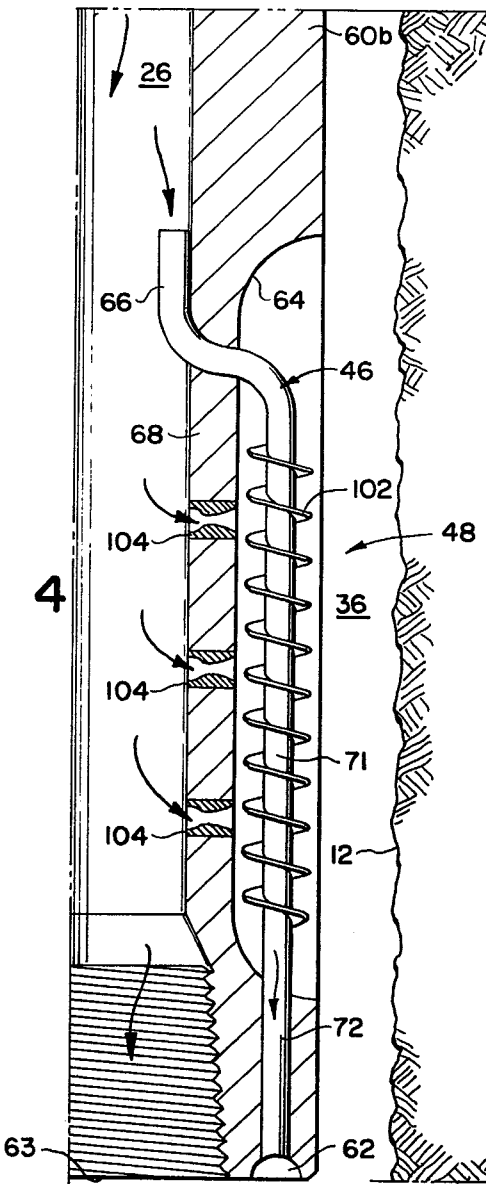
Figure 3:
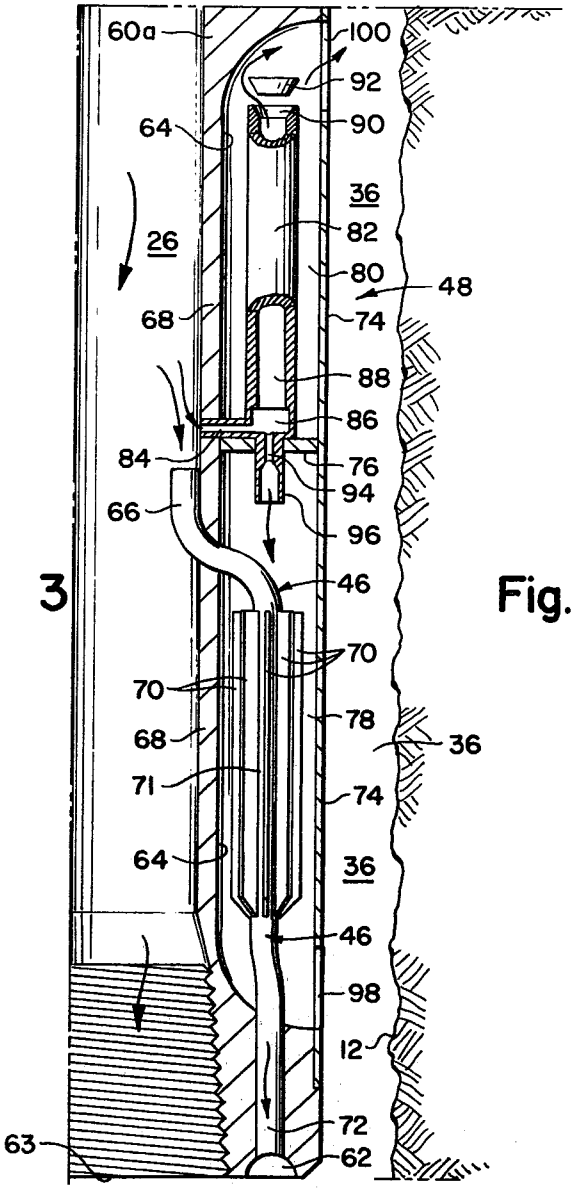

FIGS. 3, 4 and 5 are each partial enlarged vertical section views of a portion of FIG. 2 which respectively illustrate different embodiments of the cooling means disclosed in FIG. 2. FIG. 3 illustrates a vortex tube means for cooling a heat exchanger connected to the conduit. FIG. 4 discloses a plurality of expanding nozzle means for cooling a heat exchanger connected to the conduit. FIG. 5 discloses a plenum defined within a drill string member and having an external shell structure functioning as a heat exchanger for transferring heat from the flow stream to the ambient environment surrounding the member.

Figure 6:
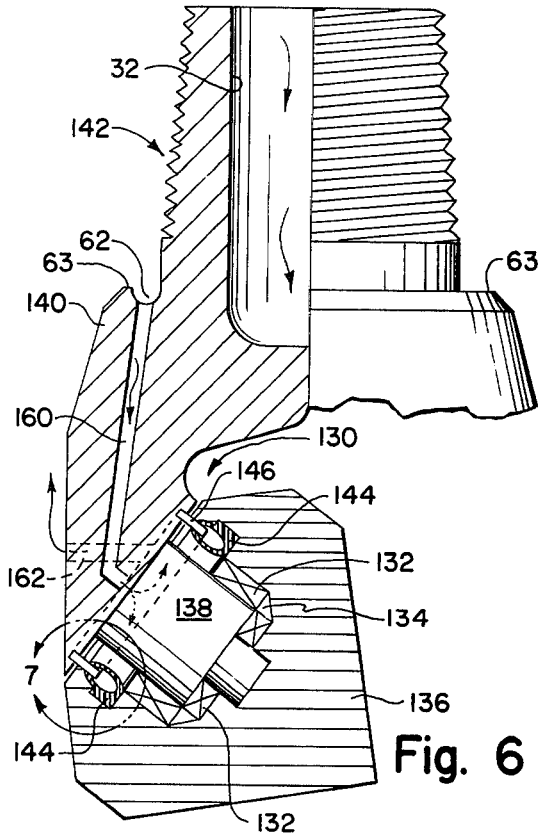

FIG. 6 is an enlarged partial view of a drill bit with the left hand half vertically sectioned to illustrate one embodiment of a seal assembly pertinent to the present invention.

Figure 7:
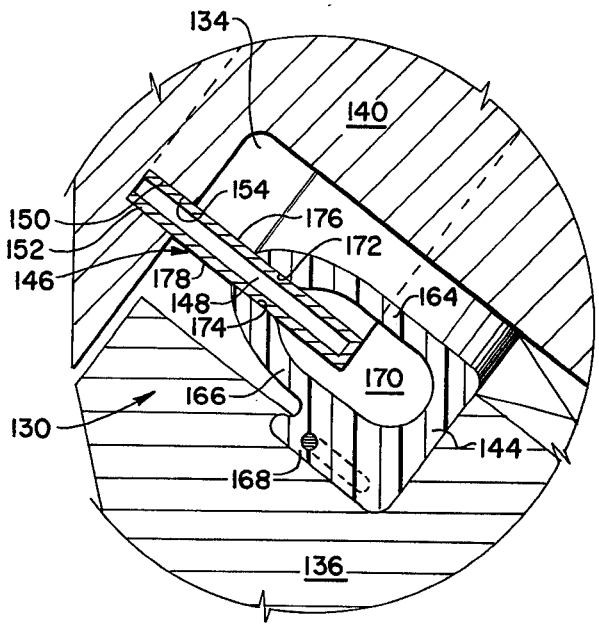

FIG. 7 is an enlarged partial view taken substantially in the area bounded by line 7—7 of FIG. 6.

Figure 8:
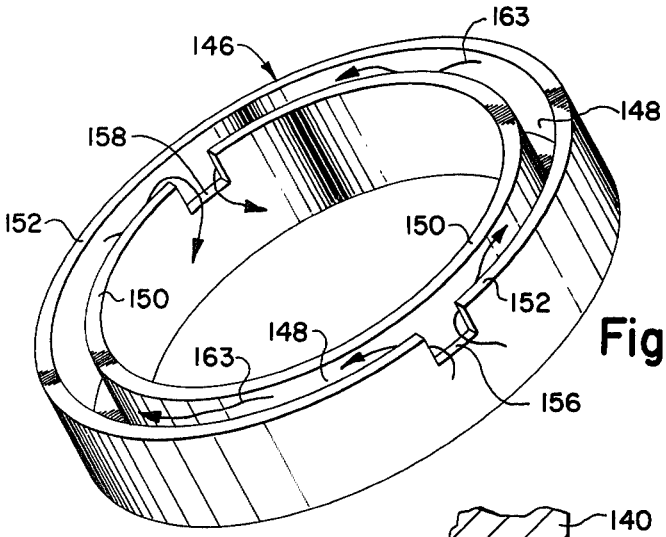

FIG. 8 is a perspective view of a projection member of the seal assembly illustrated in FIGS. 6 and 7.

Figure 9:
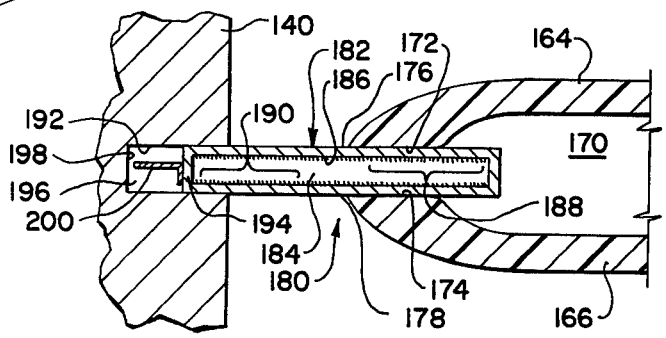

FIG. 9 is an enlarged view similar to FIG. 7, illustrating another embodiment of the seal assembly employing a heat pipe means as part of the projection member.

Figure 10:
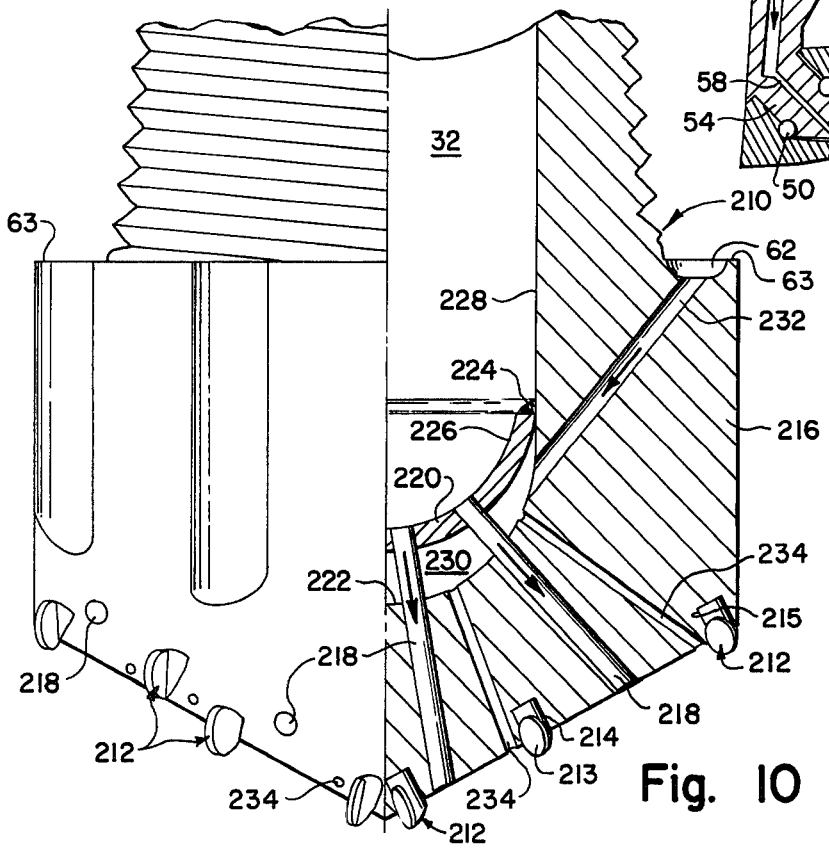

FIG. 10 is a partial view of a drag-type drill bit pertinent to the present invention employing diamond material cutting elements with the right-hand portion being vertically sectioned.

PREFERRED EMBODIMENTS

Figure 1:
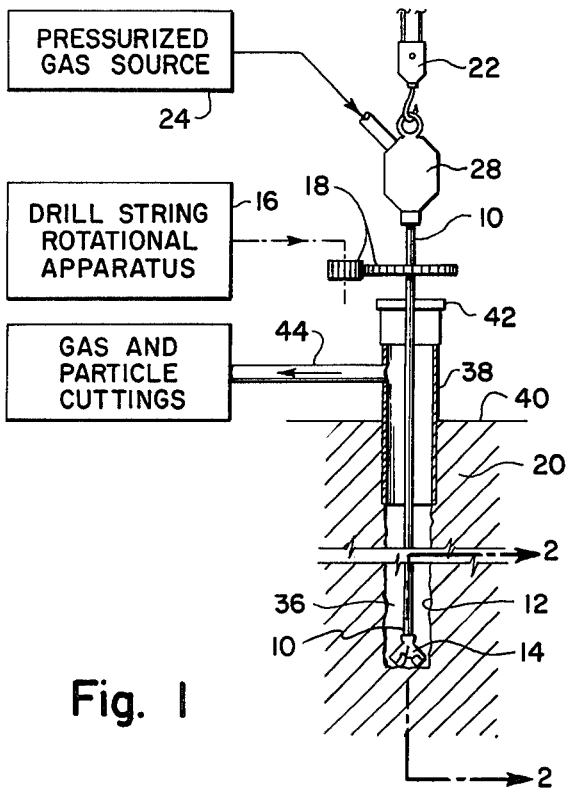
FIG. 1 is an exemplary schematic and block diagram of a pressurized gaseous drilling fluid circulation drilling system.

The present invention pertains to a gaseous drilling fluid circulation drilling system having salient details generally exemplified in FIG. 1. A drill string 10 extends into a borehole 12 and a drill bit 14 is connected to the lower terminal end of the drill string 10. Drill string rotational apparatus 16 rotates the drill string 10 through appropriate gearing 18. Downward force is transmitted by the drill string to the drill bit 14 and the drill bit is forced into a rotary cutting relationship with an earth formation 20 through which the borehole 12 is formed. A crane 22 or other suitable vertical support means regulates the amount of weight applied on the drill bit 14 to achieve the most effective cutting relationship in accordance with the type of earth formation 20 which is being drilled.

Pressurized gaseous drilling fluid from a source 24 is introduced into the borehole in order to remove the particles of the earth formation 20 which are cut from the formation by the drill bit 14. The pressurized drilling gas from the source 24 is conducted into a hollow drilling fluid passageway 26 of the drill string 10, shown in FIG. 2, through a swivel joint 28 operatively connected between the upper terminal end of the drill string 10 and the crane 22. The swivel joint 28 applies axial force from the crane 22 to the drill string, allows the drill string 10 to rotate with respect to the crane 22 and the drilling fluid source 24, and contains the pressurized drilling gas within the drilling fluid passageway 26 at the upper end of the drill string. The drilling fluid passageway 26 extends the full length of the drill string 10 to the drill bit 14. The drill bit is connected to the terminal end of the drill string by a typical connection provided by threads 30, as shown in FIG. 2. A drilling fluid cavity 32 is formed in the drill bit and operatively terminates the lower end of the drilling fluid passageway 26. Wash jets or nozzles 34 extend from the drilling fluid cavity 32 and expel jets of drilling gas onto the drill face of the borehole. The drilling gas expands as it passes through the nozzles 34 and fills the annulus 36 with reduced pressure gas. Particle cuttings removed from the earth formation by cutting elements of the drill bit are picked up by the jets of drilling gas and are carried upwardly out of the borehole in the annulus 36 between the borehole 12 and the exterior of the drill string 10 and drilling tools attached to the drill string. A casing pipe 38 is cemented or otherwise sealed into the borehole 12 near the surface 40 of the earth formation. A seal 42 extends between the casing 40 and the drill string 10. The gas and particle cuttings conducted upward through the annulus 36 are removed from the casing pipe 38 by a discharge pipe 44. The drilling gas, typically air, which is removed from the borehole can be expelled into the environment, and the particle cuttings are collected and periodically removed to a different location. The drilling gas is pressurized to impart to it sufficient energy to lift the particle cuttings up the annulus 36 and out of the borehole. The source 24 of pressurized drilling gas is typically provided by one or more engine-driven air compressors.

The applicability of the present invention to the gaseous drilling fluid circulation drilling system is generally appreciated by reference to FIG. 2. A conduit 46 extends from the drilling fluid passageway 26. The conduit 46 separates a flow stream of pressurized drilling gas from that drilling gas present in the drilling fluid passageway 26 and supplies the separate flow stream to cooling means generally referenced at 48. The cooling means 48 operatively reduces the temperature of the flow stream in the conduit 46 to a temperature less than the temperature of the gas in the passageway 26. The reduced temperature flow stream is conducted from the cooling means 48 through the conduit 46 to a drilling tool component to be cooled.

One example shown in FIG. 2 of a drilling tool component to be cooled is a bearing means 50. The bearing means 50 operatively rotationally positions a cutter wheel 52 on a journal pin 54 of the drill bit 14. The reduced temperature flow stream is conducted from the conduit 46 through passageways 56 and 58 formed in the drill bit 14. Passageway 58 expels the reduced temperature flow stream of gas into the open spaces between the journal pin 54 and the cutter wheel 52 and over the elements of the bearing means 50. The reduced temperature flow stream of gas from the cooling means 48 more effectively removes heat and thereby cools the bearing means than gas taken directly from the drilling fluid passageway. After cooling the tool component the flow stream is then expelled into the ambient environment surrounding the drill bit. U.S. Pat. No. 2,661,932 discloses a typical air drilling bit construction.

The conduit 46 is permanently and rigidly attached to or formed in a pipe 60 which forms one length of the drill string 10. Since the terminal end of the conduit 46 may not coincide with the entrance passageway 56 formed in the adjoining connected drilling tool, e.g. the bit 14, when threaded together, an annular passageway 62 may be formed in one or both of the abutting end walls 63 of the connected drilling tools 60 and 14. The passageway 60 conducts the reduced temperature flow stream of gas between the connected tools 14 and 60 without regard to their rotational alignment after they have been threaded together. Although the bearing means 50 has been illustrated as cooled by the reduced temperature flow stream from the cooling means 48, many other types of drilling tool components may also be cooled by the flow stream.

Details of various embodiments of the cooling means 48 and the conduit 46, and their relationship to the drill string 10 and the length of drill pipe are best understood by reference to FIGS. 3, 4 and 5.

The embodiment of the cooling means 48 illustrated in FIG. 3 is positioned in a milled pocket 64 formed into the exterior side of a pipe **60*a* of the drill string. An inlet 66 of the conduit 46 extends through a sidewall 68 of the drill pipe 60*a* and into the drilling fluid passageway 26. The pressurized drilling gas within the passageway 26 is conducted into the conduit inlet 66, and the gas drilling fluid flowing into the inlet 66 of the conduit 46 defines the flow stream. The remaining portion of the pressurized drilling gas within the passageway 26 is conducted on through the drill pipe 60*a* to the adjoining connecting drilling tool (not shown in FIG. 3). The inlet 66 portion of the conduit 46 is sealed into the sidewall 68 in a fluid-tight manner to prevent the escape of pressurized drilling gas from the passageway 26 into the milled pocket 64**.

In order to remove heat from the flow stream of gas flowing through the conduit 46, heat exchanger means in the form of a plurality of heat radiating fins 70 is thermally connected to a middle segment 71 of the conduit 46. The fins 70 project radially outward from the conduit 46 and extend axially parallel along the length of the middle segment 71 of the conduit 46. The fins 70 thermally induce the transfer of heat from the flow stream to the environment surrounding the fins 70. The flow stream of gas flowing through the heat exchanger means is cooled, and its temperature is reduced to a temperature less than the temperature of the drilling gas in the drilling fluid passageway 26 introduced into the inlet 66 of the conduit 46. After passing through the middle segment 71 of the conduit 46 to which the fins 70 are attached, the reduced-temperature flow stream continues through the conduit to an outlet 72 opening into the annular passageway 62 formed in the lower terminal end wall 63 of the drill pipe length 60*a*. The reduced-temperature flow stream is conducted from the annular passageway 62 through appropriate passageways in the adjoining connected drilling tool (not shown) and to the drilling component to be cooled, as has previously been explained.

A cover plate member 74 is attached to the exterior surface of the drill pipe length 68 to partially enclose the milled pocket 64. A partition 76 extends from the sidewall 68 to the cover plate 74 and defines the interior of the milled pocket into a lower chamber 78 and an upper chamber 80. The lower chamber 78 contains therein the middle segment of the conduit 46 between the inlet 66 and the outlet 72 and the heat exchanger means defined by the plurality of fins 70 thermally connected to the middle segment of conduit.

A vortex tube means 82 is positioned primarily within the upper chamber 80. A vortex tube is a well known device which separates a single supply of pressurized gas into a flow component of decreased temperature gas and into a separate flow component of increased temperature gas. The vortex tube 82 receives a supply of pressurized gas, in this case pressurized drilling gas, directly from the passageway 26 through an inlet means 84. The inlet means 84 directs a plurality of jets of gas tangentially into a vortex generation chamber 86. The tangential gas jets flow circularly within the vortex generation chamber 86 and expand and gain sonic or near-sonic velocity. The gas leaves the vortex generation chamber 86 and spirally moves through a hot gas chamber 88 toward a hot gas outlet 90. Centrifugal force keeps the gas moving away from the vortex generation chamber 86 in a zone near the outside cylindrical surface of the hot gas chamber 88 as it moves toward the outlet 90. A frustoconically-shaped control valve device 92 is positioned to converge into or toward the hot gas outlet 90. The position of the control valve 92 controls the amount of hot gas which escapes from the outlet 90 and also controls the degree of hot/cold separation of the gas. The portion of the gas which does not exit the outlet 90 is forced to the center of the hot gas chamber 88 and is conducted through the center of the chamber 88 back toward and through the center of vortex generation chamber 86 and through a orifice 94 to a cold gas outlet 96. The temperature of the gas emitted from the cold gas outlet 96 is substantially less than either the temperature of the gas at the inlet means 84 or at the hot gas outlet 90.

The cold gas obtained by operation of the vortex tube 82 is conducted downwardly into the lower chamber 78 by the cold gas outlet 96. The cold gas outlet 96 extends through and is sealed to the partition 76. The cold gas supplied from the outlet 96 into the lower chamber 78 removes heat from the fins 70 of the heat exchanger and thereby defines a cooling stream of gas to the heat exchanger. The cooling stream of gas cools the separate flow stream flowing through the conduit 46.

An outlet 98 is defined through the cover plate 74 at the lowermost position of the lower chamber 78. The outlet 98 conducts gas from the lower chamber 78 into the annulus 36. Flowing the cooling stream of gas from the cold gas outlet 96 downward through the lower chamber 78 achieves good heat transferring effects from the fins 70. The alignment of the fins with the flow of the cooling stream contributes to the heat transferring effect by channeling the cold gas flow over substantially the whole surface area of the fins.

The hot gas exhausted from the hot gas outlet 90 of the vortex tube 82 is conducted out of the upper chamber 80 into the annulus 36 by an outlet 100 formed in the upper end of the cover plate 74. By forming the outlet 100 in the upper end of the chamber 80, the maximum removal effect of the hot gas from the chamber 80 into the annulus 36 is obtained due to the natural upward movement of warm gas. The warmer gas exiting from the outlet 100 flows upward and does not interfere with the flow of cooler gas from the outlet 98.

The separate chambers 78 and 80, the partition 76, the separation of the outlets 98 and 100, and upper position of the warmer gas outlet 100 with respect to the cooler gas outlet 98 obtain good thermal separation for achieving the best thermal effects obtainable from the vortex tube 82 and from the heat transfer occurring between the fins 70 and the cold gas from the outlet 96.

It is noted that the cold gas from the cold gas outlet 96 of the vortex tube is not restricted. The cold cooling gas flows freely into the lower chamber 78 and surrounds the fins 70. The pressure of the gas in the drilling fluid passageway 26 and the pressure of the gas in the annulus 36 define the pressure differential for operation of the vortex tube 82. No intermediate pressures create restrictions. It is very important that the flow of cold cooling gas from the cold gas outlet 96 not be substantially restricted. Restricting the cold gas flow from the vortex tube creates a back pressure which restricts the flow of cold gas from the vortex tube and degrades the performance of the vortex tube. By impairing the flow of cold gas from the outlet 96 and creating a back pressure, the temperature of the cold gas is substantially increased and its flow rate is decreased, as compared to unrestricted performance.

A substantial improvement is obtained from the present invention as a result of using a separate heat exchanger defined by the fins 70 and removing heat from the separate flow stream within the heat exchanger by the cold cooling gas from the vortex tube, as compared to a prior disclosed use of a vortex tube in drilling equipment set forth in U.S. Pat. No. 2,861,780. In this prior U.S. patent, the cold gas from the vortex tube is directly conducted to a bearing assembly. The clearance spaces between the moving parts and between the elements of the bearing assembly are very close, thus creating a significantly reduced size passageway through which the gas must flow. The reduced size of this passageway creates a substantial back pressure resisting the flow of the gas from the vortex tube. Consequently the vortex tube performance is severely limited and the temperature of the cold gas is not maximally reduced. By use of the separate heat exchanger and the relatively unimpeded flow of cold cooling gas from the vortex tube into the environment surrounding the heat exchanger, in accordance with the present invention, maximum cooling effects are obtained. Because the flow stream in the conduit 46 is separate from the cold cooling stream of gas issuing from the vortex tube the performance and operation of the vortex tube becomes independent of the cooling flow effects of the gas through the drilling tool component. The performance of the vortex tube can be adjusted for maximum cooling efficiency. Back pressures created by the flow of gas through the drilling tool component do not adversely affect the performance of the vortex tube. The full pressure differential between the gas pressure in the drilling fluid passageway 26 and the gas pressure in the annulus or ambient environment of the tool is available to force a high volume of cooler air through the drilling tool component. The higher pressure and greater volume of cooling gas more effectively cool the drilling tool component and prevent the entry of particle cuttings into the clearance spaces of the tool component.

Details of another embodiment of the cooling means 48 of the present invention are illustrated in FIG. 4. The embodiment of the cooling means 48 shown in FIG. 4 is also positioned in a milled pocket 64 in a drill pipe length **60*b*. The inlet 66 of the conduit 46 extends into the drilling fluid passageway 26. The inlet 66 extends through and is sealed in the sidewall 68. The outlet 72 of the conduit 46 conducts the flow stream of gas into the annular passageway 62 formed in the lower end wall 63 of the drill pipe 60*b*. Heat exchanger means in the form of a helical cooling fin 102 is thermally attached to and spirals around the middle segment 71 of the conduit 46. The fin 102 induces the transfer of heat from the middle segment 71 of the conduit 46 and from the flow stream of gas within the conduit 46**.

The helical cooling fin 102 defining the heat exchanger means is thermally immersed and surrounded in an environment of reduced temperature drilling gas conducted directly from the passageway 26 through nozzles 104. The nozzles 104 are sealed in the sidewall 68 of the drill pipe **60*b*. As the pressurized gas in the passageway 26 flows through the nozzles 104 it is expanded and its temperature is reduced. The expanded and reduced temperature drilling gas issuing from the nozzles defines a cooling stream of gas for the heat exchanger in this embodiment. A sufficient number of nozzles 104 are provided so that the cooling fin 102 is surrounded in a stream and environment of reduced-temperature cooling gas. After removing heat from the heat exchanger the stream of cooling gas is conducted into the annulus 36 and out of the borehole 12. The flow stream of gas flowing through the conduit 46 is reduced in temperature to a temperature substantially less than the temperature of the drilling fluid in the conduit 26, by the thermal transferring effects of the heat exchanger to the cooling gas. The heat exchanger means defined by the cooling fin 102 is again thermally separate from the drilling tool component to be cooled thereby obtaining an independent and enhanced cooling effect on the flow stream in the conduit 46**.

Although not illustrated, the plurality of nozzles 104 could be replaced by one or more turbines which receive pressurized gas from the conduit 26 and which expel the gas onto the cooling fin 102. The turbine is in reality a series of nozzles and the expansion which occurs within the turbine cools the gas exhausted from the turbine. Any useful work obtained from the turbine could be dissipated as heat and delivered to the drilling fluid in the annulus 36 at a position substantially thermally separated from the location of the heat exchanger defined by the cooling fin 102.

A cover plate similar to the cover plate 74 illustrated in FIG. 3 could be utilized with the embodiment shown in FIG. 4 if it was desired to protect or isolate the heat exchanger cooling fin 102 from the environment of the annulus 36. Of course, an outlet similar to that illustrated at 98 in FIG. 3 would also be provided.

In the embodiment of the cooling means 48 shown in FIG. 4, the flow stream of gas conducted to the drilling tool component is separate from the stream of cooling gas surrounding the heat exchanger. Thermal effects of the separate streams of drilling gas can again be optimized. The desired volume flow and pressure characteristics of the flow stream through the drilling tool component can also be optimized.

Details of a further embodiment of the cooling means 48 of the present invention are illustrated in FIG. 5. An annular indention 106 is formed or turned into the sidewall 68 of a drill pipe **60*c*. A cylindrical shell member 108 is sealed and attached to the remaining full-size end portions 110 of the drill pipe 60*c*. The annular indention 106 and the shell member 108 thus define an annular, axially-extending plenum 112 or chamber through the middle portion of the drill pipe 60*c*. An inlet 114 is formed from the drilling fluid passageway 26 to the plenum 112. The inlet 114 conducts the flow stream of drilling gas from the drilling fluid passageway into the plenum 112. An outlet 116 extends from the lower end of the plenum to the annular passageway 62 in the end wall 63 of the drill pipe 60*c*. The annular passageway 62 conducts gas from the plenum 112 to the passageways in the adjoining connected drilling tool leading to the drilling tool component to be cooled. The inlet 114 and the annular plenum 112 and the outlet 116 define the conduit (referenced 46 in FIG. 2**) through which the flow stream is conducted.

The shell member 108 is preferably formed of relatively thin high heat conductivity material. The shell member 108 acts as a heat exchanger means for inducing the transfer of heat from the flow stream in the plenum 112 to the stream of drilling gas in the annulus 36 carrying the particle cuttings out of the borehole 12. The drilling gas in the annulus 36 adjacent the shell member 108 has been expanded as it was expelled from the wash jet nozzles 34 (FIG. 2) of the drill bit. The gas continues to expand in the annulus as it moves upward out of the borehole. Expanding the gas in the annulus has reduced its temperature compared to the temperature of the pressurized drilling gas within the passageway 26 and within the plenum 112. The high thermal conductivity of the shell member 108 transfers heat from the flow stream of gas in the plenum 112 to the gas in the annulus and cools the flow stream in the plenum to a temperature less than the temperature of the drilling gas in the passageway 26, prior to delivery to the outlet 116 and to the drilling tool component to be cooled. The drilling gas in the annulus thus defines the cooling stream of gas for the heat exchanger in this embodiment.

In order to minimize the flow of heat from the gasses flowing in passageway 26 into the plenum 112, a layer of insulation 118 is attached to the exterior surface of the sidewall 68 at the annular indention 106. The reduced-temperature flow stream in the plenum 112 is more effectively thermally insulated from the sidewall 68 which may be warmed by the warmer drilling gas in the passageway 26.

In order to enhance the thermal transfer characteristics of the shell member 108, or if it is desired to replace the high thermal conductivity material of the shell member 108 with low thermal conductivity material, a plurality of heat pipes 120 can be employed. The heat pipe is a well known heat transfer means capable of transferring many hundreds of times more heat than a copper conductor, for example, of the equivalent size. As is known, the heat pipe is a closed, hollow enclosure having wicking material attached to the inner surface of the hollow interior. A heat transfer liquid is disbursed through the wicking material and a part of the heat transfer liquid vaporizes in the open center of the heat pipe. An evaporator section 122 of the heat pipe receives the heat. The heat vaporizes the heat transfer liquid and the vaporized heat transfer liquid is conducted through the open center of the heat pipe to a condenser section 124. The vaporized heat transfer fluid is condensed into liquid at the condenser section 124 and the heat of vaporization is expelled from the enclosure of the heat pipe at the condenser section 124. The liquid heat transfer fluid then flows through the wicking material back to the evaporator section where the described process continues. These salient features of a heat pipe means are also described in conjunction with FIG. 9.

In the embodiment illustrated in FIG. 5, each heat pipe 120 has its evaporator section 122 positioned within the plenum 112 to receive heat from the flow stream flowing within the plenum. The condenser section 124 of each heat pipe 120 is positioned in thermal contact with the environment of the annulus so that the cooling stream of drilling gas passing through the annulus will remove the heat from each condenser section 124. Cooling of the flow stream as it passes through the plenum 112 is thus effected. The flow stream of drilling gas flowing through the heat exchanger is separate from the cooling stream of gas which removes heat from the heat exchanger. Optimum performance of both separate streams of gas can be readily achieved.

The evaporator section 122 of each heat pipe assembly is positioned at a lower elevation than the condenser section 124. By placing the condenser section at a higher level the flow of liquid working fluid in the wicking material toward the evaporator section is facilitated. Centrifugal force on the liquid working fluid due to rotation of the drill pipe **60*c* in the drill string might otherwise tend to hold the liquid working fluid in the condenser section and impede proper operation of the heat pipes 120**.

The reduced-temperature flow stream of gas may be supplied to a variety of different drilling tool components to be cooled, including the bearing means illustrated in FIG. 2. As used herein a drilling tool component includes those tools and equipment and subparts thereof used directly in drilling as well as for various other attendant functions, such as instruments for surveying, for example. Two particularly important applications of the reduced-temperature flow stream are in cooling particular types of seal assemblies illustrated in FIGS. 6 to 9 and in cooling cutting elements of a drill bit illustrated in FIG. 10.

A particular type of seal assembly 130, shown in FIGS. 6 and 7, which has been invented by the inventor herein and which is also set forth in the prior copending application entitled Caliper Seal Assembly, is particularly advantageous for use with the reduced-temperature flow stream obtained by the embodiments of the cooling means 48 of the present invention. The seal assembly 130 is designated a caliper seal assembly and is operative to contain lubricant within bearing means 132 and the space enclosing the bearing means known as a bearing lubricant cavity 134 which extends between two relatively moving parts, for example. The bearing means 132 operatively rotationally support a cutter wheel 136 with respect to a rotationally stationary journal pin 138. The journal pin 138 is an integral part of a body 140 of a drill bit 142. The drill bit 142 includes the typical drilling fluid cavity 32 which terminates the drilling fluid passageway 26 (FIG. 2) and from which the jets of drilling gas are expelled to carry the particle cuttings from the borehole by wash jet nozzles 34 (FIG. 2).

The caliper seal assembly 130 includes a flank supporting structure 144 operatively connected to and sealed with one of the relatively moving parts, for example the cutter wheel 136. A flange-like projection 146 is operatively connected to and sealed with the other of the movable parts, for example the bit body 140. The flange-like projection 146 is formed with a hollow fluid conducting interior conduit 148. The flange-like projection 146 may actually be formed as an annular ring with a U-shaped cross sectional configuration, and the two free ends 150 and 152 of the U-shaped annular ring are pressed, welded or otherwise firmly attached in an annular notch 154 formed in the drill bit body 140. An inlet relief 156 is formed in the end 152 of the flange-like projection, and an outlet relief 158 is formed in the other free end 150. The inlet and outlet reliefs 156 and 158 thereby define a continuous flow path through the conduit 148 along the full extent of the conduit 148. A passageway 160 is drilled or otherwise formed through the bit body 140 between the annular passageway 62 in an end wall 63 of the drill bit 142 and the inlet relief 156 when the flange-like projection 146 is positioned in the annular notch 154. The passageway 160 conducts the reduced temperature flow stream of pressurized drilling gas from one of the embodiments of the cooling means 48 to the interior conduit 148 of flange-like projection 146. Another passageway 162 is drilled or formed in the drill bit body 140 from the outlet relief 158 at its location within the annular notch 154. The passageway 162 conducts the flow stream of drilling gas from the interior conduit 148 to the ambient environment in the annulus of the borehole after the reduced-temperature flow stream has passed through the length of the interior conduit 148 along the path represented by the arrows 163 shown in FIG. 8. Because the pressure of the reduced-temperature flow stream of gas supplied from the cooling means through the passageway 160 to the conduit 148 is of pressure greater than that of the ambient environment in the borehole, a continuous supply of fluid or gas is forced through the interior conduit 148. The flow stream moving through the interior conduit continually cools the flange-like projection 146 and removes heat from the flange-like projection 146 because of the thermal conducting effect and relationship of the conduit 148 with the heat conductive projection 148.

One source of heat influx to the flange-like projection 146 is from the relative movement of the elements of the seal assembly 130. The flange-like projection 146 is, of course, fixed in a nonrotational sense to the drill bit body 140. The flank supporting structure 144 is fixed to the cutter wheel 136 and rotates with the cutter wheel. A pair of flexible flank members 164 and 166 extend away from the end 168 of the structure 144 contacting the cutter wheel 136. The pair of flexible flank members 164 and 166 define a bifurcated other end of the support structure 144. The flank members 164 and 166 are separated by an open intermediate or interior channel 170. Contact pad sealing surfaces 172 and 174 are respectively formed on the terminal ends of the flank members 164 and 166. Preferably the flank members and contact pads are formed of flexible elastomeric material. The contact pads 172 and 174 contact sealing surfaces 176 and 178, respectively, formed on opposite sides of the flange-like projection 146. The sealing surfaces 176 and 178 are preferably flat and smooth and operatively effect a movable sealing relationship with the contact pad sealing surfaces 172 and 174 respectively. Lubricant fills the lubricant cavity 134 and the interior channel 170. The relative frictional movement of the contact pads 172 and 174 over the sealing surfaces 176 and 178 generates one source of heat influx to the flange-like projection. Another source of heat influx is that conducted through the lubricant in the cavity 134 from the bearing means 132. The continuous flow stream of reduced-temperature drilling gas through the interior conduit 148 very effectively removes heat from the seal assembly 130.

The reduced-temperature flow stream of drilling gas supplied by the various embodiments of the cooling means 48 can also be advantageously used in conjunction with another embodiment 180 of a caliper seal assembly shown in FIG. 9, which employs a heat pipe within its flange-like projection 182. The flank supporting structure, the flank members 164 and 166, the contact pad sealing surfaces 172 174 and the sealing surfaces 176 and 178 are the same as had previously been described in conjunction with FIG. 7. The flange-like projection 182 defines a hermetically sealed interior chamber 184. Wicking material 186 is attached to the sidewalls of the interior chamber 184 and extends generally parallel to the exterior sealing surfaces 176 and 178. A charge of appropriate working fluid is inserted into the interior chamber 184 before it is hermetically sealed. The heat pipe defined within the flange-like projection 182 operates in the typical manner. An evaporator section 188 removes the heat generated by the relative frictional movement of the contact pads 172 and 174 over the sealing surfaces 176 and 178. The liquid working fluid in the wicking material 186 at the evaporator section is vaporized. The vaporized fluid travels through the open center of the chamber 184 and condenses at a condenser section 190 retained to the drill bit body 140. The condensed fluid travels back through the wicking material to the evaporator section. The working fluid transfers the thermal energy from the evaporator section 188 to the condenser section 190.

The flange-like projection 182 is retained at its condenser section 190 in an annular groove 192. The annular groove 192 extends to depth into the member 140 past a terminal end 194 of the flange-like projection. Accordingly, an open space 196 exists between the terminal end 194 and an innermost wall 198 of the groove 192. A heat radiator fin 200 is thermally connected to the end 194 of the heat pipe flange-like projection and extends into the open space 196.

The annular open space 196 defines a conduit through which the member 140 through which the reduced-temperature flow stream of drilling gas from one of the embodiments of the cooling means 48 is conducted. Passageways similar to those referenced 160 and 162 in FIG. 6 are formed through the member or drill bit body 140 to deliver and exhaust the flow stream from the conduit defined by the open space 196. Heat is transmitted to the open space 196 because of a thermal conducting relationship existing between the condenser section 190 and the open space 196. The radiator fin 200 assists in the very effective heat transfer from the condenser section to the flow stream in the conduit defined by the open space 196. The heat pipe embodiment of the flange-like projection 182 of the seal assembly 180 is capable of greatly enhanced heat removal capabilities. Combined with the highly effective cooling obtained from the reduced-temperature flow stream passing through the open space 196, the resulting combination achieves greatly improved thermal transfer characteristics in gaseous drilling fluid systems.

By removing the heat more effectively, the seal assemblies 130 and 180 are capable of prolonged lifetimes of use. In fact, the highly improved heat transfer and removal characteristics of the present invention exhibit a substantial potential for obtaining the first known effective application of sealed lubricated bearings in gas circulation drill bits and tools. Heretofore, the substantially elevated operating temperatures of gas drilling bits have prevented the reasonably successful adaptation and use of lubricated sealed bearings in gas drill bits. Lubricated sealed bearings provide an increased liftime of use than, and are generally recognized as desirable over, the gas flushed bearing assemblies exemplified by the aforementioned U.S. Pat. No. 2,661,932.

A new and improved drag-type drill bit 210, illustrated in FIG. 10, is particularly advantageous for improved and more effective utilization in gas circulation drilling systems. The drag bit 210 contains no moving parts but includes a plurality of cutter elements 212 adapted to frictionally contact and scrape or remove materials from an earth formation. Each of the cutter elements 212 includes a layer 213 of material characterized by extreme hardness and wear resistance which contacts and scrapes away the earth formation. This layer 213 of material is defined herein as diamond material and may comprise natural diamond material, man-made diamond material or a wide variety of man-made polycrystalline abrasive materials known in the art of drag bits. This layer of hard, wear resistant material is attached by a low temperature bond, typically a brazing-type bond, to a stud 214 of high strength and impact resistance such as cemented tungsten carbide, as is also known in the art. The resulting structure formed by the layer 213 of diamond material bonded to the stud 214 of high strength and impact resistance forms each cutter element 212. Each of the cutter elements 212 is rigidly attached in pockets 215 formed in the body 216 of the bit 210.

The drill bit body 216 also defines the conventional drilling fluid cavity 32. Drilling fluid is expelled from the cavity 32 through nozzle tubes 218 onto the drill face of the earth formation and the expelled drilling fluid removes the particle cuttings from the drill face.

A relatively large amount of heat is generated by the frictional scraping contact of the cutter elements 212 with the earth formation during use of the drag bit 210. This relatively high heat can damage and seriously weaken the bond of the layer 213 of diamond material to the stud 214, unless the cutter element is cooled. A weakened or destroyed bond causes the layer of diamond material to disconnect from the stud. Shortly thereafter the drill bit is rendered ineffective or ruined because the stud itself is incapable of satisfactory performance as a cutting element. Because of this temperature limitation, drag bits employing diamond material cutting elements have usually been effective only in liquid drilling fluid drilling systems because the liquid drilling fluid possesses a sufficient capacity to effectively remove the heat. In gas drilling, drag bits with diamond material cutting elements have not prooved substantially successful because the cutter elements cannot withstand the elevated temperatures present because of the limited cooling capacity of the gas drilling fluid. The present invention exhibits a significantly enhanced capability for rendering drag bits employing diamond material cutter elements effective in air drilling.

The improved drag bit 210 of the present invention employs a partition member 220 positioned within the drilling fluid cavity 32. The partition member 220 is spaced above the terminal end wall 222 of the cavity 32. The partition member is held in position by welds 224, or other sealing attachment means which attach the periphery 226 of the partition member 220 to the inner sidewall 228 of the bit body 216 defining the cavity 32. The nozzle tubes 218 extend through the partition member 220 and communicate with the drilling fluid in the drilling fluid passageway and cavity 32. The nozzle tubes 218 are sealed to the partition member 220. A sealed chamber 230 is thus defined between the partition member 220 and the end wall 222. Drilling fluid in the cavity 32 is prevented from entering the chamber 230.

The reduced temperature flow stream of drilling gas is supplied to the chamber 230 through a passageway 232 from the annular passageway 62 formed in the adjoining end wall 63 of the bit 210. Of course, one embodiment of the cooling means 48 of the present invention supplies the reduced-temperature flow stream to the annular passageway 62. One cooling jet passageway 234 extends from the chamber 230 through the drill bit body 216 and terminates at a position rotationally in advance of and adjoining each cutter element 212. The cooling jet passageway 234 defines means for expelling reduced temperature gas into a thermal transferring relationship with each diamond material cutter element 212.

Each jet of reduced temperature cooling fluid emitted in direct thermal relation to the cutter element 212 removes heat from each cutter element and assists in maintaining the integrity and strength of the bond of the layer 213 of diamond material to the stud 214. The enhanced heat reducing capabilities available from the present invention exhibit improved capabilities for utilizing drag-type drill bits in applications heretofore not regarded as practical.

The significant objectives and advantages of the present invention have been discussed. In general however, it should be noted that a reduced-temperature flow stream of gas drilling fluid is available in accordance with the present invention for creating significant cooling effects on various drilling tool components. That reduced-temperature flow stream of cooling gas is obtained from the single source of pressurized gaseous drilling fluid supplied to the drilling fluid passageway of the drill string, thereby avoiding the necessity for numerous auxiliary and different sources of cooling fluid and involved gas delivery apparatus. In all cases the reduced-temperature flow stream is obtained by thermodynamic effects from another portion of the supplied drilling fluid, and the thermodynamic effects occur in the borehole. Use of the reduced-temperature flow stream in conjunction with the caliper seal assemblies and a diamond material drag bit disclosed herein provide significantly advanced improvements in the field of gas drilling systems.

The embodiments, systems, processes and improvements of the present invention have been shown and described with a degree of specificity. It should be understood, however, that the specificity of the description has been made by way of preferred example and that the invention is defined within the scope of the appended claims.

What is claimed is:

1. An improved method of cooling a drilling tool component of a gaseous drilling fluid circulation drilling system, comprising the following steps:

conducting a supply of pressurized drilling gas into a borehole through a drilling fluid passageway for the primary purpose of carrying particle cuttings out of the borehole, separating in the borehole a part of the supplied drilling gas into a flow stream separate from the remaining drilling gas in the drilling fluid passageway, conducting the whole of the flow stream to the drilling tool component to be cooled, passing the flow stream through a heat exchanger which is thermally separate from the drilling component to be cooled prior to conducting the flow stream to the drilling tool component to be cooled, and cooling the flow stream in the heat exchanger to a temperature less than the temperature of the remaining drilling gas in the drilling fluid passageway by thermally immersing the heat exchanger in a cooling stream of drilling gas separate from that of the flow stream and that in the drilling fluid passageway, the cooling stream having been reduced in temperature due to thermodynamic effects of the cooling stream drilling gas within the borehole.

2. A method as defined in claim 1 wherein the cooling stream of drilling gas is obtained by steps comprising:

directly removing a second stream of drilling gas from the drilling gas remaining in the drilling fluid passageway, reducing the temperature of the drilling gas in the second stream to a temperature less than the temperature of the drilling gas in the flow stream, and directing the second stream over the heat exchanger.

3. A method as defined in claim 2 wherein reducing the temperature of the drilling gas in the second stream comprises:

expanding the drilling gas of the second stream after it has been removed from the drilling fluid passageway and before it is directed over the heat exchanger.

4. A method as defined in claim 3 wherein expanding the drilling gas of the second stream comprises:

passing the second stream through means defining a nozzle.

5. A method as defined in claim 1 wherein the cooling stream of drilling gas is obtained by steps comprising:

directly removing a second stream of drilling gas from the drilling gas remaining in the drilling fluid passageway, separating the second stream into a first flow component of elevated temperature and a second flow component of reduced temperature, the second flow component having a temperature substantially less than the temperature of the second stream and of the first flow component, directing the first flow component into the borehole without substantial thermal contact with the heat exchanger, and substantially immersing the heat exchanger in the second flow component.

6. A method as defined in claim 5 wherein separating the second stream into first and second flow components comprises:

passing the second stream through a vortex tube.

7. A method as defined in claim 1 wherein the cooling stream of drilling gas is obtained by steps comprising:

expanding in the borehole the drilling gas which is carrying particle cuttings out of the borehole to reduce the temperature of the drilling gas carrying the particle cuttings, and positioning the heat exchanger in thermally conducting relation with the expanding drilling gas of reduced temperature which is carrying the particle cuttings out of the borehole.

8. A method as defined in claim 1 wherein only a single supply of pressurized drilling gas is conducted into the drilling fluid passageway, and the single supply is employed for both cooling the drilling tool component and removing the particle cuttings from the borehole.

9. Apparatus for cooling a drilling tool component in a gaseous drilling fluid circulation drilling system, in which said drilling system comprises a drill string defining a drilling fluid passageway therein for conducting pressurized drilling gas into the borehole formed by the drilling system, a drilling tool component operatively connected to said drill string, and means supplying pressurized drilling gas to the drilling fluid passageway, said cooling apparatus comprising:

conduit means extending from the drilling fluid passageway to the drilling tool component for conducting the whole of a flow stream of drilling gas from the drilling fluid passageway to the component, heat exchanger means thermally connected to said conduit means between the drilling fluid passageway and the drilling tool component, said heat exchanger means being substantially thermally isolated from the drilling tool component, said heat exchanger means thermally inducing the transfer of heat from the whole of the flow stream of drilling gas passing through said conduit means prior to the drilling gas being conducted to the component;

means positioning said heat exchanger means on the drill string and within the borehole to direct heat transferred from said heat exchanger means into the environment exterior of the drill string in the borehole.

10. Apparatus as recited in claim 9 further comprising:

means operatively conducting a second cooling stream of drilling gas from the drilling fluid passageway into the environment surrounding said heat exchanger means and for thermodynamically reducing the temperature of the second stream to a temperature less than the temperature of the flow stream encountering the heat exchanger means.

11. Apparatus as recited in claim 10 wherein said means operatively conducting the second stream and for thermodynamically reducing the temperature of the second stream comprises:

vortex tube means operatively attached to the drill string, said vortex tube means including a chamber having an inlet for drilling gas extending to the drilling fluid passageway, and a hot outlet for gas extending to the exterior of the drill string at a point thermally separated from said heat exchanger means, and a cold outlet for gas extending to the environment surrounding said heat exchanger means.

12. Apparatus as recited in claim 10 wherein said means operatively conducting the second stream and for thermodynamically reducing the temperature of the second stream comprising:

nozzle means for communicating the second stream directly from the drilling fluid passageway to the environment surrounding said heat exchanger means, said nozzle means operatively reducing the temperature of the second stream by expanding the volume and reducing the pressure of the drilling gas in the second stream as it passes through said nozzle means.

13. Apparatus as recited in claim 10 wherein said heat exchanger means comprises:

means defining a plenum within a member of the drill string and in said conduit means, said plenum being defined in part by an exterior shell member separating the plenum from the borehole environment surrounding the drill string member, said exterior shell member being of thermal conductivity for thermally inducing the transfer of heat from the flow stream within the plenum to drilling gas in the borehole environment.

14. Apparatus as recited in claim 10 wherein said heat exchanger means comprises:

means defining a plenum within a member of the drill string and in said conduit means, said plenum being defined in part by an exterior shell member separating the plenum from the borehole environment; and heat pipe means extending through the exterior shell member and having an evaporator section extending to the plenum and having a condenser section extending to the exterior of the shell member, said heat pipe means operatively transferring heat from its evaporator section to its condenser section into the borehole environment.

15. Apparatus recited in claims 10, 11, 12, 13 or 14 wherein:

said drilling tool component comprises bearing means movably supporting two relatively moving parts of a drilling tool, and the flow stream of drilling gas is conducted between the two relatively moving parts to said bearing means.

16. Apparatus as recited in claims 10, 11, 12, 13 or 14 wherein:

said drilling tool component comprises a flange-like projection of a seal assembly operative between two relatively moving members, said flange-like projection defining a hollow interior having an inlet and an outlet; and the flow stream of drilling gas is conducted into the inlet to the hollow interior of the flange-like projection and out of the outlet to the hollow interior of the flange-like projection.

17. Apparatus as recited in claims 10, 11, 12, 13 or 14 wherein:

said drilling tool component comprises a plurality of diamond material cutter elements attached to a drag-type drill bit, said drill bit comprising a plurality of cooling jet means for expelling drilling gas into thermal transferring relation with each diamond material cutter element, and the flow stream of drilling gas is conducted through the drill bit to each said cooling jet means.

18. Apparatus operative in a gaseous drilling fluid drilling system wherein a drilling fluid passageway extends in a drill string and conducts pressurized drilling gas into the borehole for the primary purpose of carrying particle cuttings out of the borehole, said apparatus comprising in combination:

a lubricant seal assembly operative between two relatively movable parts of a drilling tool of said drilling system, said seal assembly comprising:

a flank member operatively connected to one of said relatively movable parts, said flank member including a contact sealing surface formed thereon;

a projection member operatively connected to the other of said relatively movable parts, said projection member including a sealing surface formed thereon in movable sealing relation with the contact sealing surface of said flank member; and a fluid conductive conduit extending in thermally conductive relationship with said projection member, said conduit including an inlet and an outlet; and means operative from the pressurized drilling gas for reducing the temperature of a flow stream of drilling gas to a temperature less than the temperature of the drilling gas in the drilling fluid passageway and for supplying the reduced-temperature flow stream to the inlet of said conduit whereby to remove heat from said projection member.

19. Apparatus as recited in claim 18 wherein said fluid conductive conduit is formed interiorly within said projection member.

20. Apparatus as recited in claim 18 wherein said seal assembly further comprises heat pipe means operatively positioned within said projection member, said heat pipe means including a condenser section in thermal transferring relationship with said fluid conductive conduit.

21. Apparatus operative in a gaseous drilling fluid drilling system wherein a drilling fluid passageway extends in a drill string and conducts pressurized drilling gas into the borehole for the primary purpose of carrying particle cuttings out of the borehole, said apparatus comprising in combination:

a drag-type drill bit attached to the drill string, said drill bit comprising a plurality of diamond material cutter elements attached to said drill bit, and cooling jet means for expelling fluid into thermal transferring relation with each diamond material cutter element, and means for conducting fluid to each said cooling jet means; and means operative from the pressurized drilling gas for reducing the temperature of a flow stream of drilling gas to a temperature less than the temperature of the drilling gas in the drilling fluid passageway and for supplying the reduced-temperature flow stream to said means for conducting fluid to each said cooling jet means whereby to remove heat from each diamond material cutter element.

22. Apparatus as recited in claims 18 or 21 wherein said means operative from pressurized drilling gas for reducing the temperature of the flow stream and for supplying the reduced-temperature flow stream to one said recited drilling tool component comprises:

conduit means extending from the drilling fluid passageway to the drilling tool component;

heat exchanger means thermally connected to said conduit between the drilling fluid passageway and the drilling tool component, said heat exchanger means being substantially thermally isolated from the drilling tool component, said heat exchanger means thermally inducing the transfer of heat from the whole of the flow stream of drilling gas passing through said conduit means prior to the drilling gas being conducted to the component;

means positioning the heat exchanger means within the borehole to direct heat transferred from the heat exchanger means into the environment exterior of the drill string in the borehole; and means operatively conducting a second stream of drilling gas from the drilling fluid passageway into the environment surrounding the heat exchanger means and for thermodynamically reducing the temperature of the second stream to a temperature less than the temperature of the flow stream encountering the heat exchanger means.

23. Apparatus as recited in claims 18, 19 or 20 wherein the lubricant seal assembly further includes:

a pair of said flank members separated by an intermediate channel, said projection member extending into the intermediate channel, said projection member including sealing surfaces formed on opposite sides thereof, and the contact sealing surface of each flank member contacting an opposite sealing surface of the projection member.

* * * * *